United States Patent [19]

Braun

[11] 3,976,315

[45] Aug. 24, 1976

[54] GATE LOCK

[76] Inventor: Louis G. Braun, R.F.D. No. 1, Spearfish, S. Dak. 57783

[22] Filed: Aug. 21, 1975

[21] Appl. No.: 606,353

[52] U.S. Cl. ..... 292/104; 292/113; 292/247

[51] Int. Cl.[2] ..... E05C 19/12

[58] Field of Search ..... 292/104, 113, 205, 240, 292/247, 248; 160/328

[56] References Cited

UNITED STATES PATENTS

| | | | |
|---|---|---|---|
| 726,332 | 4/1903 | McCaslin | 292/113 |
| 1,042,757 | 10/1912 | Bird | 292/113 |
| 1,190,587 | 7/1916 | Roda | 292/247 |
| 1,392,934 | 10/1921 | Glandt | 292/247 |
| 1,549,321 | 8/1925 | Macfarland | 292/247 |
| 2,613,972 | 10/1952 | Gifford | 292/247 |

*Primary Examiner*—Robert L. Wolfe
*Attorney, Agent, or Firm*—Beall & Jeffery

[57] ABSTRACT

A gate lock for locking a gate to a fence which comprises a first arm mounted on a fence post for rotational movement relative thereto and a second arm having a curved end portion adapted to extend around said gate post for locking the same. The arms are pivotally connected to permit movement of the second arm relative to the first arm between a position enclosing the gate post and a second position free of the gate post to permit opening of said gate. The arms are provided with openings which are aligned when the arms are in a locking position to receive a padlock or the like.

4 Claims, 4 Drawing Figures

FIG. 1
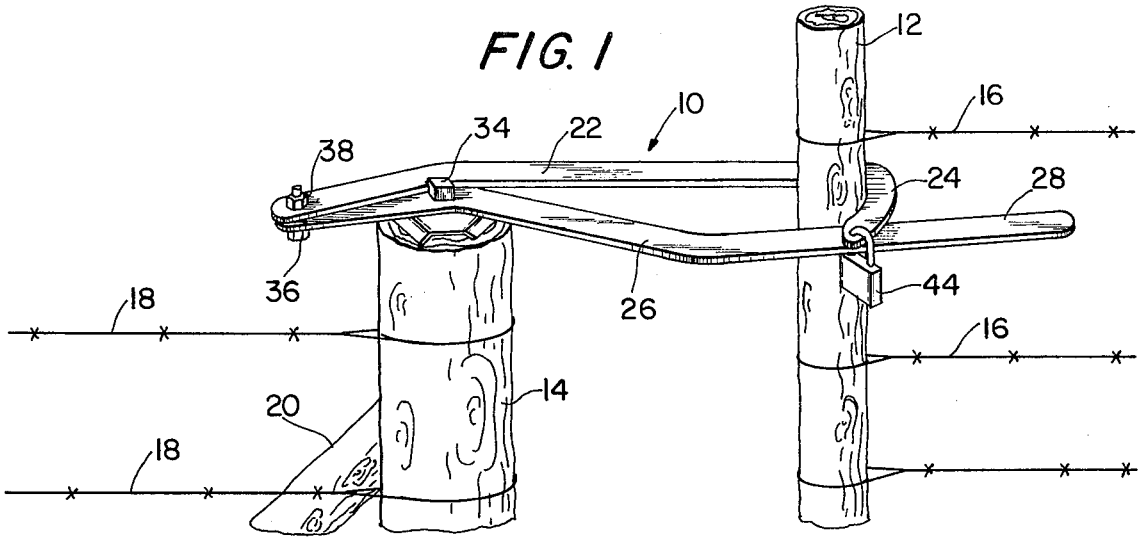
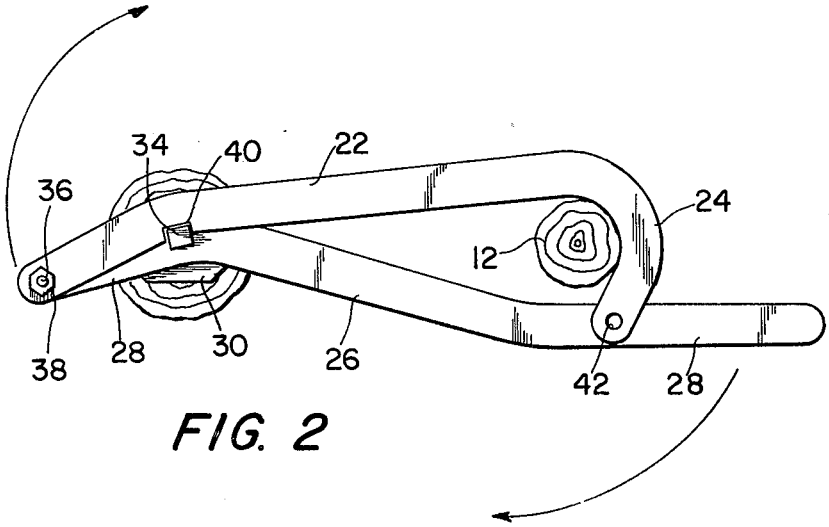
FIG. 2
FIG. 3
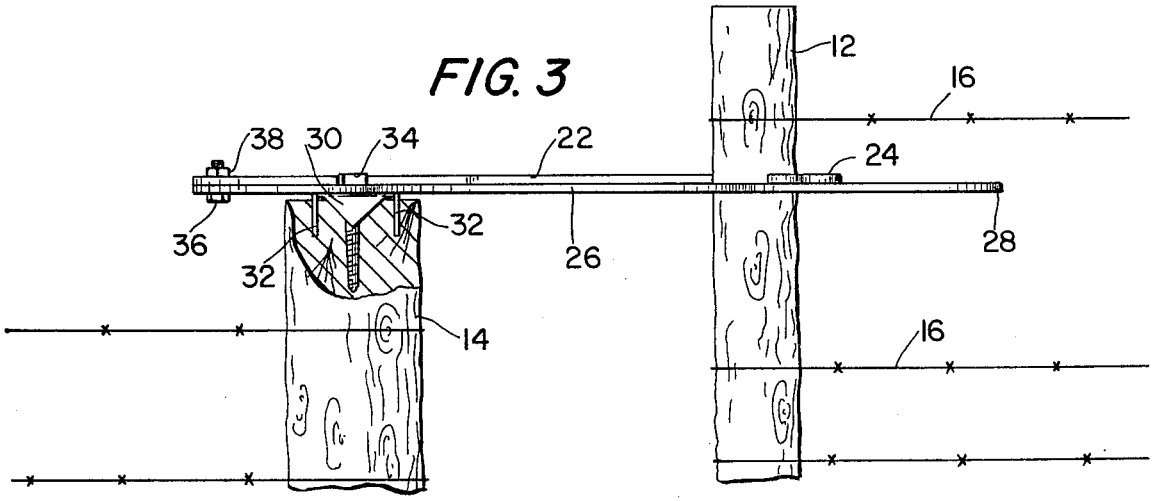

GATE LOCK

BACKGROUND OF THE INVENTION

The present invention relates as indicated to a gate lock and relates more specifically to a lock for locking a gate post to a stationary fence.

The prior art contains various types of gate locks or fasteners for fastening wire gates to wire fences, and exemplary of such art are U.S. Pat. Nos. 1,264,120; 1,772,326; 2,704,900; 2,747,909 and 2,860,429. These patents are commonly characterized by a fastening device for fastening or locking the upper end of the gate post to the fence post and a lower connection for the posts, normally in the form of a looped member interconnecting the lower portions of the post together when the gate is closed. Although these prior patents are generally satisfactory for the purpose intended, no provision is normally made for securing the locking members together, for example, by means of a padlock or the like, for additional protection, and prior art constructions are frequently characterized by being either relatively expensive to manufacture and/or difficult to install and operate.

SUMMARY OF THE PRESENT INVENTION

A primary object of the present invention is to provide a gate lock for locking a gate to a stationary fence wherein the lock can be quickly and easily mounted on a fence post and quickly and easily operated for moving the components of the gate lock between open and closed positions.

A further, more specific object of the invention is to provide a gate lock which is comprised of a pair of pivotally connected arms one of which is mounted for rotational movement relative to the fence post and the other of which is responsive to such rotational movement for clearing the gate post to permit swinging movement of the same. A closely related object of the invention resides in the construction and interconnection of the arms so that when the arm rotatably mounted on the fence post is moved to a closed position, openings formed in both arms are automatically aligned when in the fully closed position for receiving a padlock or the like for locking the gate to the fence.

Yet another object of the present invention is to provide a gate lock which is inexpensive to manufacture and which can be quickly installed on the fence post and which can be easily operated to lock or release the gate.

These and other objects of the invention will be apparent as the following description proceeds in particular reference to the application drawings.

BRIEF DESCRIPTION OF THE APPLICATION DRAWINGS

In the application drawings,

FIG. 1 comprises a front perspective view of the gate lock constructed in accordance with the invention, with the gate lock being shown mounted on the fence post and gate and in a locked condition;

FIG. 2 is a top plan view of the gate lock, in locked position;

FIG. 3 is a front elevational view of the gate lock, shown partially in section in order to more clearly illustrate the manner in which the lock is mounted on the fence post.

DETAILED DESCRIPTION OF THE PREFERRED EMBODIMENT

Figure 4:
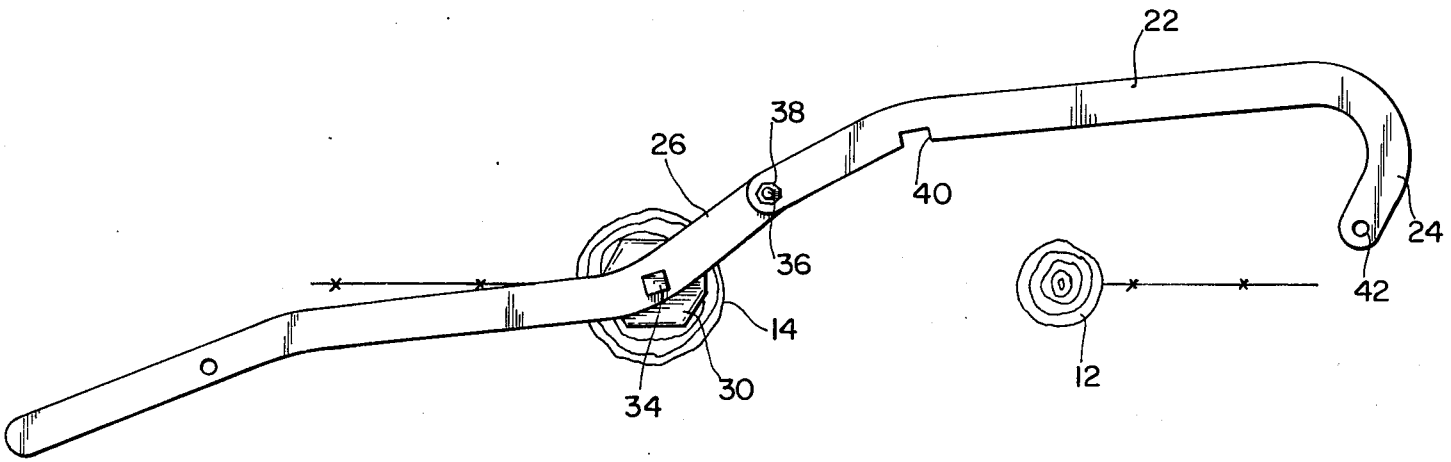
FIG. 4 is a top plan showing the gate lock in an open position to permit opening of the gate.

Referring now in more detail to the application drawing, wherein like parts are indicated by like reference numerals, the gate lock constructed in accordance with the present invention is generally indicated at 10 and functions to lock the fence gate, which is fragmentarily shown in the drawing and which includes a gate post 12, to the stationary fence post 14. The construction of the gate and fence per se forms no part of the present invention and have accordingly been shown fragmentarily in the drawings. The gate includes vertically spaced barbwire strands commonly indicated at 16, and the stationary fence likewise includes barbwire strands commonly indicated at 18 secured to the post 14 and to adjoining posts in conventional manner. A brace 20 is secured to the post 14 adjacent the upper end thereof for bracing the same.

The gate lock 10 includes a first arm 22 having a generally semicircular end portion 24 and a second arm 26 below said first arm and having an outer end portion 28 which extends beyond the end of the curved end portion 24 of the arm 22 when the arms are locked as shown in FIGS. 1-3.

The arm 26 further includes a reversely bent end portion 28 which is mounted for pivotal movement relative to the fence post 24 by means of a bracket 30 formed with generally triangular shaped downwardly extending flanges commonly designated at 32 by means of which the bracket can be driven into the top of the fence post. Once the bracket is firmly mounted on the fence post, the arm 26 is loosely mounted on the bracket by means of lag screw 34 which extends through aligned openings in the bracket and arm 26 and into the top of the fence post 14, which is normally constructed of wood material. The mounting of the arm 26 on the fence post by the lag screw is such as to permit rotation of the arm 26 relative to the vertical axis through lag screw during unlocking movement of the gate lock as will hereinafter be described. The lag screw is preferably formed with a smooth shank portion near the head of the lag screw to facilitate rotation of the arm 26 around the screw axis. The mounting of the bracket 30 also function to prevent splitting of the fence post when the lag screw is subsequently secured thereto.

The rear ends of the arms 22 and 26 are apertured to receive a bolt 36 and nut 38 for securing such ends together while at the same time permitting movement between such end portions for permitting opening and closing movement of the gate lock. The aperture formed in bar 22 is preferably threaded and the nut 38 is preferably a lock or jamb nut.

As noted in FIG. 3, the lag screw 34 has a square head and the arm 22 is formed with a rectangular notch 40 to receive the head 34 when the arms 22 and 26 are in their FIG. 2, closed position. When in such closed position, openings 42 formed in the outer ends of the arms 22 and 26, with only hole 42 in arm 22 being visible in FIG. 2, are vertically aligned for receiving a lock 44 for locking the arms together with the curved end 24 of the arm 22 enclosing the post 12.

To open the gate, the lock 44 is opened and removed. The arm 26 is then rotated clockwise as shown by the arrow in FIG. 2 about the vertical axis through the lag screw 34 with such movement of arm 26 effecting movement of the arm 22 away from the fence post, as shown by the arrow in FIG. 2, due to the pivotal connection between the arms 22 and 26 through the bolt 36 and nut 38. Such movement initially clears the notch 40 from engagement by the head of the lag screw 34, with continued rotation of the arm 26 moving the arm 22 into its FIG. 4 position wherein the curved end 24 thereof clears the gate post 12 thereby permitting swinging movement of the gate, counterclockwise as shown in FIGS. 2 and 4, for opening the same. It will thus be seen that the gate lock can be simply and quickly moved to a position permitting the gate to be swung open by simply rotating the arm 26 in the direction indicated after the lock 44 has been removed.

When it is desired to again lock the gate, the gate post 12 is repositioned in its FIG. 1 orientation and the arm 26 rotated counterclockwise. The arms 22 and 26 are returned to their FIG. 2 position in which the curved end 24 of the arm 22 encloses the gate post 12. The movement of the arms is terminated when the head of the lag screw 34 engages the notch 40, in which position the openings 42 in the free ends of the arms are aligned for receiving the lock 44 for locking the gate.

It will be noted that although the stationary fence post is shown on the left of the gate post in the application drawings, it will be apparent that the gate lock could be reversed for mounting on a fence post located at the right of the gate post. It will also be apparent that minor changes could be made in the gate lock construction shown without, however, departing from the concepts of the present invention.

I claim:

1. A gate lock for locking a gate post to a fence post comprising:

a. a first arm, and means for mounting said first arm on a fence post for rotational movement relative thereto, b. a second arm having a curved end portion adapted to extend around said gate post, and c. means for pivotally connecting adjacently disposed end portions of said first and second arms to permit movement of said second arm relative to said first arm so as to permit movement of said curved end of said second arm between a first position enclosing said gate post and a second position free of said gate post to permit opening of said gate, d. the curved end of said second arm and the free end of said first arm being formed with openings which are aligned when said second arm is in said first position to receive a lock for locking said gate post to said fence.

2. The gate lock of claim 1 wherein said means for mounting said first arm on said fence post comprises a bracket having a plurality of downwardly extending, pointed flanges adapted to be driven into the top of said fence post, and screw means extending downwardly through aligned openings in the bracket and said first arm and rigidly secured in the top of said fence post.

3. The gate lock of claim 2 wherein said screw means includes a rectangular head position and said second arm is formed with a notch in one side thereof corresponding in shape to said head portion, the latter serving to provide a stop limiting the movement of said second arm into said first position to align said openings in said first and second arms for receiving said lock.

4. The gate lock of claim 3 wherein said first and second arms are constructed and interconnected in such a manner that initial rotational movement of said first arm to unlock the gate effects movement of said second arm radially away from said screw means so as to clear said notch from said head of said screw means, with continued rotation of said first arm serving to move said second arm in a direction generally parallel to an axis through said gate post and said fence post.

* * * * *